US007954655B2

(12) United States Patent
Virvo

(10) Patent No.: US 7,954,655 B2
(45) Date of Patent: Jun. 7, 2011

(54) DISPLAY WITH FOLDING SHELVES

(76) Inventor: Alexander Virvo, Stamford, CT (US)

( * ) Notice: Subject to any disclaimer, the term of this patent is extended or adjusted under 35 U.S.C. 154(b) by 548 days.

(21) Appl. No.: 11/295,791

(22) Filed: Dec. 7, 2005

(65) Prior Publication Data

US 2007/0000854 A1 Jan. 4, 2007

Related U.S. Application Data

(60) Provisional application No. 60/633,939, filed on Dec. 7, 2004.

(51) Int. Cl.
*A47F 5/08* (2006.01)

(52) U.S. Cl. ..... 211/149; 211/150

(58) Field of Classification Search ..... 211/72, 211/73, 71.01, 135, 149, 150, 168, 169.1, 211/170, 171, 193, 87.01, 90.01, 96, 90.04; 108/1–8, 134, 115; 206/749, 741, 742, 744; 220/478, 476, 475

See application file for complete search history.

(56) References Cited

U.S. PATENT DOCUMENTS 1,959,619 A * 5/1934 Ebert ..... 211/73
2,047,097 A * 7/1936 Dunbar ..... 211/169.1
2,231,091 A * 2/1941 Saulsbury ..... 221/133
2,445,164 A * 7/1948 Worthman ..... 160/127
2,671,584 A * 3/1954 Taylor, Jr. ..... 206/760
2,851,237 A * 9/1958 Welshenbach ..... 248/459
2,918,178 A * 12/1959 Leone ..... 211/195
3,045,831 A * 7/1962 Pendergrast, Jr. et al. ... 211/59.4
3,137,251 A * 6/1964 Pendergrast, Jr. ..... 108/110
3,151,576 A * 10/1964 Patterson ..... 108/2
3,462,020 A * 8/1969 Hall ..... 211/26.2
3,527,360 A * 9/1970 Thielking ..... 211/150
3,570,679 A * 3/1971 Edson ..... 211/47
3,616,938 A * 11/1971 McAleenan et al. ..... 211/150
3,677,203 A * 7/1972 Barrineau ..... 108/166
4,151,803 A * 5/1979 Ferrera et al. ..... 108/41
4,228,904 A * 10/1980 Dumond ..... 211/55
4,230,258 A * 10/1980 Lane ..... 206/585
4,311,100 A * 1/1982 Gardner et al. ..... 108/165
4,322,005 A * 3/1982 Robertson ..... 211/59.4
4,485,922 A * 12/1984 Desmond et al. ..... 206/485
4,570,805 A * 2/1986 Smith ..... 211/149
4,646,922 A * 3/1987 Smith ..... 211/186
4,688,681 A * 8/1987 Bergeron ..... 211/36
4,760,928 A * 8/1988 Bustos ..... 211/59.4
5,042,651 A * 8/1991 Davis et al. ..... 211/132.1
5,183,166 A * 2/1993 Belokin et al. ..... 211/149
5,213,220 A * 5/1993 McBride ..... 211/132.1
D336,725 S * 6/1993 Emanuel ..... D6/477
5,361,937 A * 11/1994 Wiese ..... 221/189

(Continued)

*Primary Examiner* — Jennifer E. Novosad
(74) *Attorney, Agent, or Firm* — Hoffman Warnick LLC

(57) ABSTRACT

A presentation display for use in displaying products, samples and/or premiums. The display is comprised a shelf that is attached to a backer panel by means of a flexible hinge. The display may be made with flexible material as in paperboard, or with more permanent material as in plastic, wood, metal or other suitable material. Additional shelves may be added. The orientation of the additional shelves should be in a "nesting" way where when they are in the "Up" or "Closed" position there is minimal space between the shelves ("nesting" way), and when they are in the "Down" or "Open" position the area covered up during storage or shipping is revealed, giving a substantially "open" look a and feel to the display and allowing for easy access to the product. The revealed area may contain imagery or messaging to inform, entertain or to help sell the product.

4 Claims, 9 Drawing Sheets

U.S. PATENT DOCUMENTS 5,392,902 A * 2/1995 Vlastakis ..... 211/135
5,505,318 A * 4/1996 Goff ..... 211/90.03
5,553,724 A * 9/1996 Moher et al. ..... 211/70.7
5,749,480 A * 5/1998 Wood ..... 211/169.1
5,816,419 A * 10/1998 Lamson ..... 211/150
5,826,732 A * 10/1998 Ragsdale ..... 211/149
6,269,961 B1 * 8/2001 Porcelli ..... 211/70.7
6,279,757 B1 * 8/2001 Hayoun ..... 211/40
6,302,282 B1 * 10/2001 Gay et al. ..... 211/153
7,048,131 B2 * 5/2006 Gay et al. ..... 211/187
2005/0184015 A1 * 8/2005 Cypranowski et al. ..... 211/73

* cited by examiner

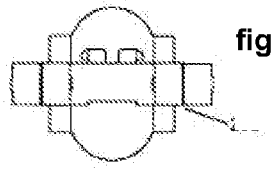
figure 5A
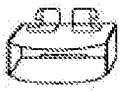
figure 5B
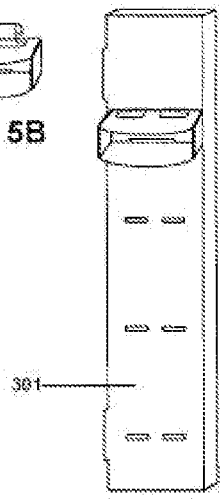
figure 5C
figure 6
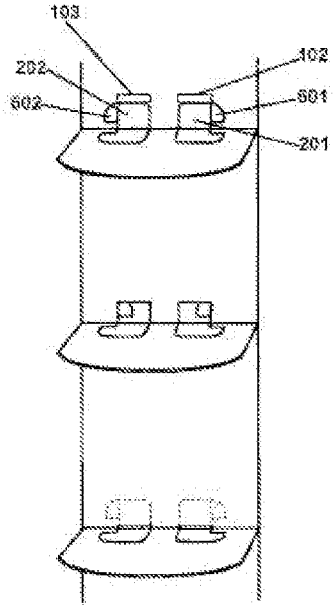
figure 7
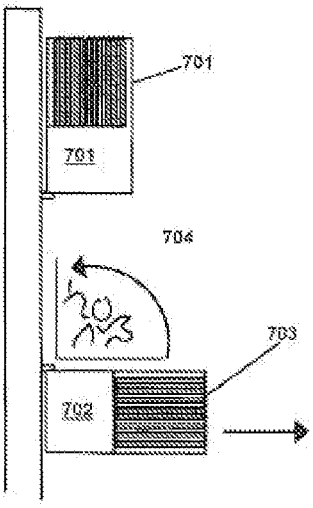
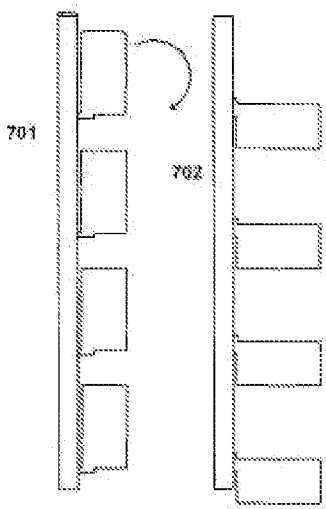
figure 8A
figure 8B
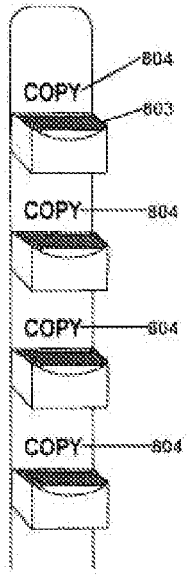
figure 8C figure 9
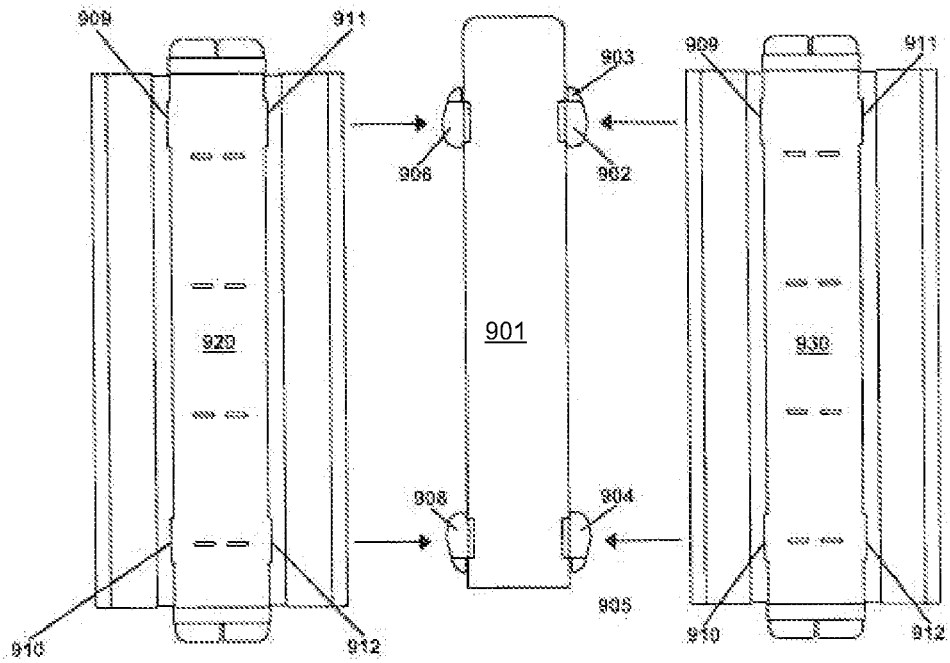
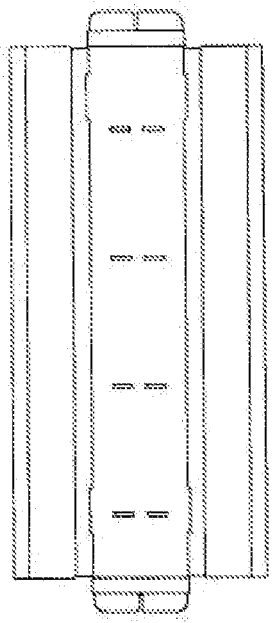
figure 10A
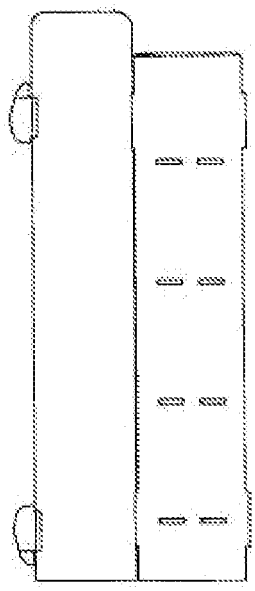
figure 10B
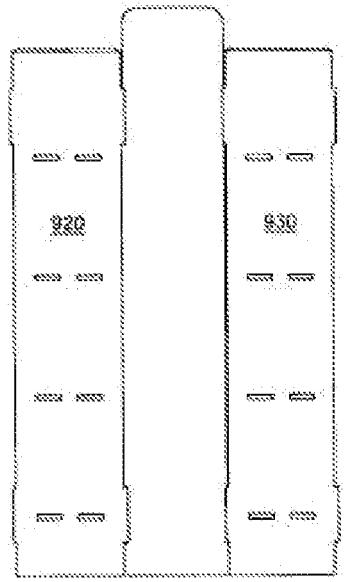
figure 11 figure 12
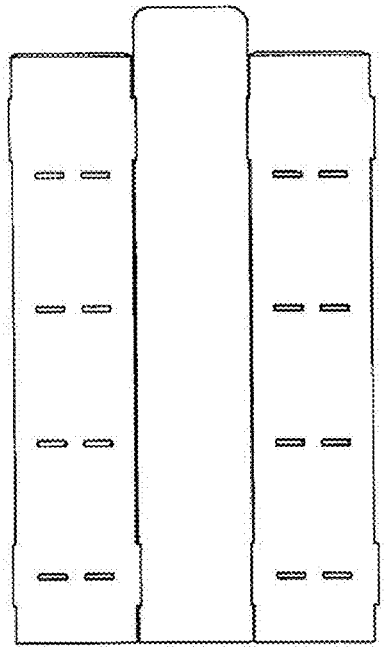
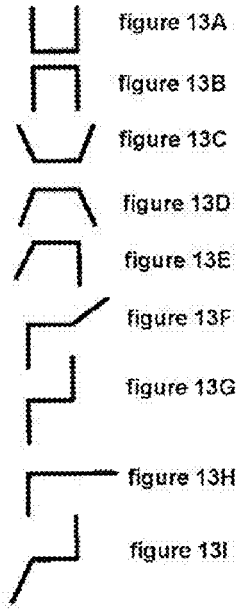
figure 15
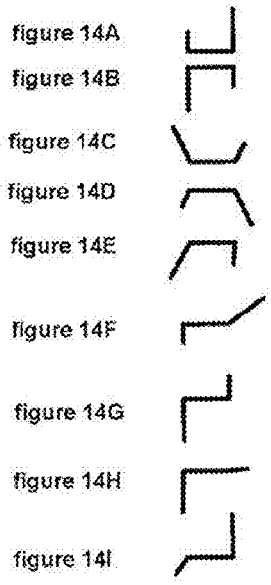
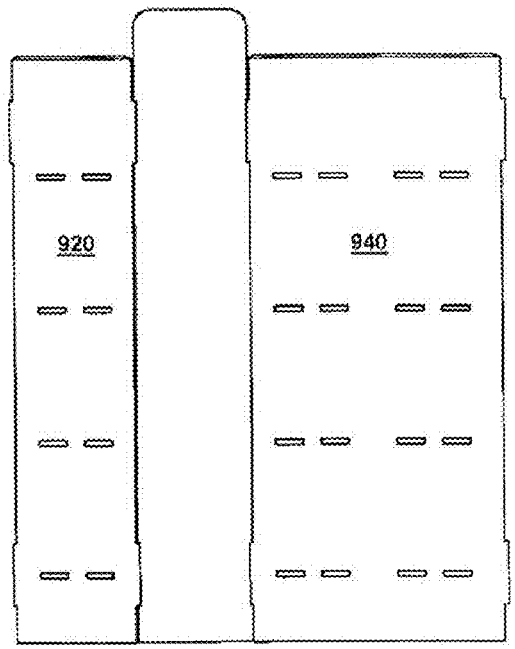

DISPLAY WITH FOLDING SHELVES

RELATED APPLICATIONS

This application claims benefit of priority of U.S. Provisional Patent Application No. 60/633,939, filed Dec. 7, 2004.

BACKGROUND OF THE INVENTION

1. Field of the Invention

The present invention relates generally to the high cost of shipping problem. Many marketers are challenged with the need to create pre-packed displays that are easy to set up and meet stringent size constraints set by retail stores. Also in our competitive retail environment there is more and more pressure on marketers to produce lower cost products and lower cost merchandisers to display their products in-store. This has forced many marketers to travel great distances, including overseas, to seek out low cost suppliers, as a result, these marketers often incur heavy shipping costs in delivering their finished goods to retailers. These high shipping costs often result in higher costs to the customers, or lower profits to the marketers and/or their retail partners. To manage these heavy shipping costs, there is a growing need for displays to ship more and more efficiently with minimal "empty or air" space, thereby maximizing the number of displays that will fit on a pallet for shipment. Any solutions to help maximize the number of displays per pallet are welcomed by marketers that ship product over great distances. Further there is a growing need for more "selling" space on a display.

Although there are many display merchandisers available to marketers, they are not always very good at balancing between, holding product efficiently and having enough space on the display to carry "selling" messages to help sell the product at retail, or in certain instances where it would be important to have the extra space in a display to show a product out of its package, such as in pop up greeting cards, pop up maps and certain pop up books. It is well known that if space is required in a display to feature "selling" messages, then less space is available to merchandise the products, and/or it would cost more to ship the products. The "empty" space in the front portion of a display is ideal for selling messages, but unfortunately all too often it is cut back in favor of having more products in a display, packed in such a way so that there is little space left for selling messages. It would be useful if there were temporary, semi-permanent, and permanent display structures that allowed marketers a better balance between having enough product in a display that ships efficiently and having adequate space for selling messages, without incurring increased shipping costs. Further, it would be desired that these displays are easy to manufacture, pack out, and set-up in-store.

2. Description of the Prior Art

1. Certain items which are usually shipped and merchandised flat, but that benefit from being displayed in an open position. Items that fall into this category include pop-up greeting cards, pop-up maps, pop up books, etc.

Pop-up greeting cards and pop-up maps are shipped flat in order to appreciate shipping efficiencies and to protect the product. Many companies selling these items will often require that an open sample is displayed in order to stimulate interest and purchase. One such company, POP SHOTS, based in Westport, Conn. ships all of their temporary and seasonal displays with an open sample of each card in their display. A display that features 12 different cards will have 12 "open" card samples for easy viewing by customers. Although this open view makes it easier to view pop-up cards, it certainly increases the cost of the display, as less cards can be packed in each display and the inefficient pack out increases the shipping cost of the display, thereby increasing the cost of the product to the retailer and/or the customer, or reducing the potential profit to the manufacturer. To elaborate, because pop-up cards require much hand labor for assembly, they are often produced in countries where the cost of labor is significantly lower than in the US, in countries such as China or India or Mexico. As a result, the cost of shipping is significant, especially if a large portion of the display being shipped to US retailers is used for the presentation of "open" pop-up greeting cards. Additionally they must be shipped in a very sturdy display to ensure that the "open" cards arrive in good saleable condition. Having a display structure that could better protect their product, and ship more efficiently and at a lower cost would be a valuable and sought after solution by all companies involved in manufacturing and selling such items.

2. Certain items are merchandised in a container with shelves with a fixed position and with empty space between the shelves to allow for easy viewing of the product and for easy access to the product.

There are a multitude of existing options for merchandising packaged goods, candies, health and beauty products, novelty items, and many other items sold in retail stores. Many displays currently in the marketplace are made as simple boxlike tray structures that sit on a base, where the product is stacked inside the tray (FIG. 22). This style of display often must be viewed from the front of the display because when it is viewed indirectly from the side, the sides of the boxlike trays obstruct to the product view. In a competitive marketplace, there is an ongoing need, to produce displays that offer an "open" look, meaning minimizing the amount of display that is seen and maximizing the amount of product that is seen by customers. To address that problem, some displays offer a flat backer panel with shelves or trays attached in a fixed position, giving the display an "open" look, offering customers a wider viewing angle and easy access to the product in the display. These displays, although attractive are very inefficiently constructed, as they usually have a significant amount of "empty or air" space between the fixed product trays, making them less efficient to ship (FIG. 23). Using conventional construction techniques, the more "open" the look of the display, the more "empty or air" space it needs to ship with. Finding a solution that both allows for a wider angle of viewing of the display at retail while maximizing shipping efficiency would enable many of today's marketers to sell more while shipping more efficiently, resulting in lower prices and/or larger profits.

3. Certain items could benefit, from an ad panel that is permanently (or near permanently) attached to the product shelves In keeping with the need to ship more efficiently, and to be able to sell more at retail, many manufacturers are seeking innovative ways to present their products in "open" style displays without losing any of the selling power, while managing their production and shipping costs. The power of in-store marketing is well known, with the early success of industry pioneer, ActMedia which was later sold to Rupert Murdoch' News Corp. News Corp's Smart Source division is today's industry leader in in-store marketing. The number most quoted is that more than 70% of the product purchasing decision are made in-store. This highly focused, and powerful buying group, makes marketers take notice of any useful ad vehicles available to them in store. The most frequently used advertising and promotional vehicles are shelf advertising, promotional displays, advertising in aisles, on carts, on video monitors, and on floor graphics, etc. It is also well known to use shipper displays as ad vehicles, since having advertising messages printed on the same display that is holding the advertised product is certain to help sell more of the product. The inherent problem with using shippers as ad vehicles is that they are often designed to hold product, and not necessarily to be ad vehicles. There is constant pressure to pack more and more product into a display, thereby reducing the amount of available ad space on the shipper. The constant struggle is between the need to pack more products into a display and the need to have the "ad" space necessary to help sell the products. The more space the product takes, the less space there is for the advertising on the display. The most popular solutions include having the ad messages printed on a separate "header" card that is placed into special slots at the top of a display. Often these "header" cards will obstruct the customer's view of other products, and will be removed by store clerks, competitors and even by store customers. Some displays address these problems in other ways, however often at a significant cost. Consider displays that offer beautiful flat display panels printed with advertising messages, that have trays or hooks attached that hold products in an "open" fashion. Again, such displays often ship with lots of "empty" space at a significant cost, or the trays are shipped pre-packed separately requiring significant effort by store clerks, or by specially trained merchandising personnel to set up the separate trays into position on these displays. Finding a display solution that better advertises a product without obstructing the customers view, and will not increase in the cost of shipping, and is easy to set up by existing store clerks, will certainly enable marketers to sell more, ship more efficiently, have better relations with retailers, resulting in their being able to offer their products at lower prices and/or enjoy larger profits.

4. Certain current display structures allow for separate shelves to be integrated into a permanent backer In certain models of organizers such as sold in hardware stores, and in certain retail fixtures such as slat walls, there are shelf systems designed to fit into a separate backer so as to easily display the contents of the shelves and to provide easy access to the products in the shelves. These systems however are only designed with the intent of displaying the products in an organized and easy to view and access fashion, and are not concerned with the need of having the shelves ship attached in a "nesting" way for efficient shipping, and ease of set up as in a retail pre-pack shipper display.

SUMMARY OF THE INVENTION

Against the foregoing background, it is the primary object of the present invention to provide a display with folding shelves that allows for the display to ship in a substantially flat profile.

It is another object of the invention to provide a display that has "nesting" shelves that are attached during shipping, minimizing the air space between shelves when they are in the ready-to-ship up position.

It is another object of the present invention to have folding shelves attached to the back of the display by foldable hinge(s) to freely swing from an open (down) position to closed (up) position allowing for the display to ship in a substantially flat profile.

It is yet another object of the present invention to offer significant space for advertising or messaging that is hidden when the shelves are folded in the "Up" position during shipping and then revealed when same shelves are in the "Down" position when the display is set up for customer view.

It is but another object of the present invention to make the shelves interchangeable, such as in permanent and semi-permanent displays, where it may be advantageous to have a display system that allows to easily switch-out shelves. One such example is where the back of the display may be made from permanent material such as wood or plastic, and the shelves could be made from a less expensive material such as paperboard, and would be switched out seasonally.

It is yet still another object of the invention, to provide a display that is considered a one piece display requiring no assembly of parts at store level, for easy portability and set-up.

It is another object of the invention, to provide a display that may be completely assembled and easily stored in a substantially flat profile for future shipment.

It is yet still another object of the present invention, to provide a display that allows for the shelves to be assembled and filled with product, then stored separately from the base of the display, for final assembly at a future date, offering yet more flexibility in fulfillment options.

It is but another object of the present invention to provide a display that would allow for separate shipment of the bases, and separate shipment of the shelves so that the bases, or backers, may be manufactured in a separate place than the shelves, creating many more fulfillment options for the manufacturer. For example the shelves may be densely packed and shipped from China, while the bases may be produced locally, and the final assembly of bases and shelves could also be done locally, saving money on shipping of bases over great distances.

It is yet another object of the present invention to provide a display that prevents damage to the product(s) being shipped, as in the example of the POP-UP greetings that can get damaged when shipped in an open fashion.

It is yet another object of the invention to provide a display with an "open" look and feel with a wide viewing angle.

It is yet another object of the current invention to provide a display that may have shelves with the folding mechanism made from the extension of the shelf material (paperboard or plastic) as in the shelf tabs (FIG. 5), or with other well known separate hinge attachments.

It is another object of the invention to provide a display with a substantially flat profile that can be stored and shipped efficiently (FIG. 2 and FIG. 3), and easily assembled at a future date.

To the accomplishments of the foregoing objects and advantages the present invention in brief summary comprises a display backer with a means for receiving separate foldable shelf(s) to be hingedly connected to the backer to allow for efficient shipping and storage. If multiple shelves are used then they would be oriented in a "nesting" way.

In the preferred embodiment, these means comprise a backer with two slits that will each receive a single shelf tab which extends from the top of the rear panel of the shelf. The shelf tab consists of a center portion that is slightly narrower than the backer slit and a right and left flap that are folded inwardly so that the tab may be inserted into the backer slit. After insertion, the right and left flaps are rotated outwardly so as to interlock the shelf to the display backer, preventing the shelf from detaching from the display backer. The orientation of the shelves should be in a "nesting" way where when they are in the "Up" or Closed position there is minimal space between the shelves ("nesting" way), and when they are in the "Down" or Open position the area covered up during storage or shipping is revealed, giving a substantially "open" look and feel to the display and allowing for easy access to the product.

The revealed area may contain imagery or messaging to inform, entertain or to help sell the product.

BRIEF DESCRIPTION OF THE DRAWINGS

The foregoing and still other objects and advantages of the present invention will be more apparent from the detailed explanation of the preferred embodiments of the invention in connection with the accompanying drawings, wherein:

FIGS. 5A-5C are plan views of shelf (FIG. 5A) and a perspective view (FIG. 5B) of the same shelf shown assembled, and a perspective view (FIG. 5C) of the display backer box structure.

FIG. 6 is a partial perspective view showing the steps necessary to attach shelf to the display backer panel.

FIG. 7 is a perspective side view of one foldable shelf in the space saving up position, and the other shelf is rotated by means of the hinge to the down position showing how shelves are oriented in a "nesting" way.

FIGS. 8A-C are a perspective view of all shelves in the up position (FIG. 8A) at the same time ready for storage and/or shipping, and in the down position (FIG. 8B) ready for display. Also shown is the display rotated to see the copy area that is revealed when shelves are in the "Down" position (FIG. 8C).

FIG. 9 is a plan view of an embodiment where a center panel connects two display backers providing yet more space for Copy or Advertising.

FIGS. 10A-B are perspective views showing one display backer box structure attached to a center panel by means of tab structure.

FIG. 11 is a perspective view showing two display backer box structures attached to either side of center panel.

FIG. 12 is a perspective view showing two display backer box structures attached to either side of center panel.

FIGS. 13A-I are top views of the FIG. 11 showing that there are number of ways that display backer box structures may be rotated in relation to a center panel.

FIGS. 14A-I are top views where the box structures, attached to a center panel are of different lengths.

FIG. 15 is a front view where the different sized display backer box structures are attached to a center panel.

BRIEF DESCRIPTION OF THE PREFERRED EMBODIMENTS

Figure 1:
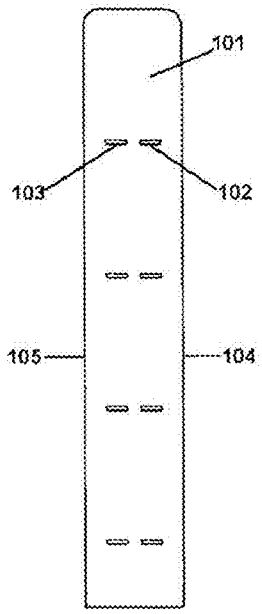
FIG. 1 is a plan view (front) of the back panel of a simple display backer structure with slits for receiving foldable shelf tabs.
Figure 2:
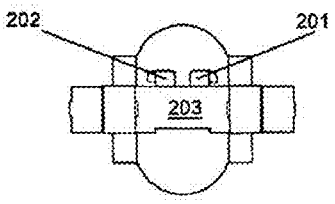
FIG. 2 is a plan view of flat shelf with shelf tabs which will serve as a hinge mechanism when attached to the back panel.

Referring to the drawings and, in particular to FIG. 1 and FIG. 2 thereof the display with foldable shelves structure of the present invention is provided and referred to generally by display backer 101 and foldable shelf 203. The simple backer display structure may be made from paperboard, plastic, foam board or any combination of substrates that would form a suitable back panel to hold display tray and/or shelves filled with product for retail display. For additional structure, the paperboard may be folded on score lines 104 and 105, and the panels (not shown) rotated behind the display and attached to the back of the display by means of glue, tape, staples or other suitable means of attachment. It is further the intent of the inventor, to make the backer display from other more durable materials for semi-permanent and permanent displays. This change in substrates may be desired for a more elegant look, or for a more durable structure. The materials for this alternate display backer may include but are not limited to plastic, wood metal, and other well known display and fixture materials.

In the preferred embodiment, the shelf structure would have a single shelf tab. Shelf tabs 202 and 201 in FIG. 2 would be merged into a single tab structure. FIG. 2 is a plan view of flat shelf 203 with shelf tabs 201 and 202 which will serve as a hinge mechanism when attached to the back panel 101. Although a flat shelf made from foldable paperboard, such as corrugated board, is the preferred embodiment. In certain instances it may be preferred to use plastic or other suitable, foldable material that could be formed into a tray or shelf. It is also the intention of the inventor to suggest that there may be instances where a solid shelf may be preferred such as injection molded plastic, as often in today's competitive retail environment more and more temporary displays are combining paper board and plastic to achieve highly stylized effects.

Figure 3:
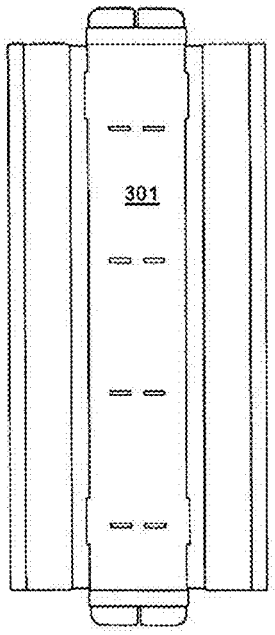
FIG. 3 is a plan view of a simple box structure display backer that when formed provides more structure to a back panel to the display, and also gives the rear of the back panel (not shown) a cleaner look as it will hide the shelf tabs.
Figure 4:
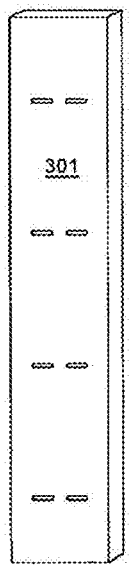
FIG. 4 is a perspective view of the display backer box structure.

In the preferred embodiment the display backer structure would have a single panel to keep costs low, however, it is the intent of the inventor, not to compromise structure and quality for cost, so when needed the display backer panel would have a finished back as shown in FIG. 3. This is a plan view of a simple box structure 301, that when formed provides more structure to back panel of the display, and also gives the rear of the back panel (not shown) a cleaner look when the structure will have many tabs inserted into it to hold shelves and other attachments that will be described in discussing FIGS. 5, 6 and 9. FIG. 4 is a perspective view of the preferred embodiments' display backer box structure 301. Although the preferred embodiment of this structure is to keep it as thin and flat as possible, it may often be necessary for the box structure to have a different shape, such as a base style structure (not shown) where the box is viewed from the side is narrow at the top and wide at the bottom so as to form a self-standing structure, as in a counter display of a floor display.

In the preferred embodiment the flat shelf structure is formed and attached to the display backer. FIGS. 5A-C are plan views of shelf 203 and a perspective view of the same shelf shown assembled, and a perspective view of box structure 301, and how shelf 203 relates to box 301, respectively. It is worth noting that box 301 is designed to hold four shelves, however, the number of shelves and the size of box 301 may increase or decrease in size to accommodate the amount and type of product(s) they will be displayed. In the preferred embodiment two foldable shelves are needed to create a "nesting" way. The display backer 301 needs to be tall enough to accommodate two shelves oriented in a "nesting" way.

FIG. 6 is a partial perspective view showing the steps necessary to attach shelf 203 (FIG. 5A) to back panel 101 or box 301. First using your fingers the mini shelf tabs 601 and 602 located on shelf tabs 201 and 202 respectively, are folded to the center of the back panel. The shelf tabs 201 and 202 are pushed through shelf slits 102 and 103. Once the shelf tabs 201 and 202 are fully inside the shelf slits 102 and 103, the mini shelf tabs 601 and 602 will securely lock shelf 203 to back panel 101 or 301. Although this is the preferred way to affix the shelves to the back panel it is the intent of the inventor to use any other suitable fastening means, including and not limited to creating a different tab structure that could serve as a hinge mechanism, or by affixing the shelf by means of a separate hinge. What is critical is that there is a hinge mechanism for these shelves. It is also important to note that it would be easy to substitute a single larger tab (not shown) for two smaller tabs 201 and 202 to serve as a hinge.

In the preferred embodiment, the foldable shelves are oriented in a "nesting" way. FIG. 7 is a perspective view one foldable shelf in the space saving Up position 701, ideal for shipping, and the other shelf is rotated by means of the hinge (described relative to FIG. 6) to the Down position 702, ideal for display. This view also discloses a pop up card 704 which is hidden and protected during storage and shipping when the shelf is in the up position 701, and is displayed open when the shelf is in the down position 702. Here it is also important to note that the product in this drawing is dispensed from the front 703 of shelf 203. This style of shelf is ideal for the presentation of pop up cards as you can view the card and easily reach to pull one for purchase.

FIGS. 8A-C are perspective views of all shelves in the Up position 701 (FIG. 8A) at the same time ready for storage and/or shipping, and in the Down position 702 (FIG. 8B) ready for display. It is important to note that shelf 803 is dispensed from the top of the tray or shelf, this style makes it ideal for display of novelties, candies, soaps, etc. Additionally when the trays/shelves are in a Down position 702 for display, messaging surface 804 is revealed. This surface may be used to excite, educate, inform or entice customers to try or buy the products shown in the display. It is important to point out here that when products are rotated to the Up or closed position 701, the messaging surface 804 is hidden from view and the trays are designed to "nest" close to each other making for a relatively flat and narrow profile minimizing the cost of shipping by reducing the amount of "empty" space in the display at the time of storage/and or shipping. Yet, when the trays are rotated to the open position 702 for display, the messaging space 804 is in full view and the product(s) in the display have maximum exposure to customers.

An alternative embodiment to add more space for ad copy or messaging is shown in FIG. 9. This is a plan view of an embodiment where a center panel 901 with tabs 902 and 904, that are inserted into openings 909 and 910 of box structure 930 (to the right of the center panel) respectively by rotating mini tabs 903 and 905 towards the center of center panel 901 and pushing the tabs through openings 909 and 910 until the mini flaps 903 and 905 fold open and form a secure lock between box 930 and center panel 901. The same actions are performed to attach another box 920 to the left of center panel 901 using tabs 906 and 908 and openings 911 and 912, respectively. It is important to note that although the tuck tab method of attachment is preferred many other suitable methods of attachment may be used to attach center panel 901 to box structures 930 and 920, including methods of attachment such as glue, hooks, fasteners, etc. Here it is important to disclose that box structures 920 and 930 are the same exact construction as box 310 and are thereby interchangeable, i.e., they were named 920 and 930 to avoid confusion. It is further important to note that a further embodiment of the invention is to allow several box structures to be attached to center panel 901 as in a daisy chain method (not shown) including structures where the box sizes may be of different sizes. FIGS. 10A-B show perspective views of the display backer box structures 930 attached to left side of center panel 901. And FIG. 11 is a perspective view showing two display backer box structures 930 and 920 attached to either side of center panel 901.

Figure 16:
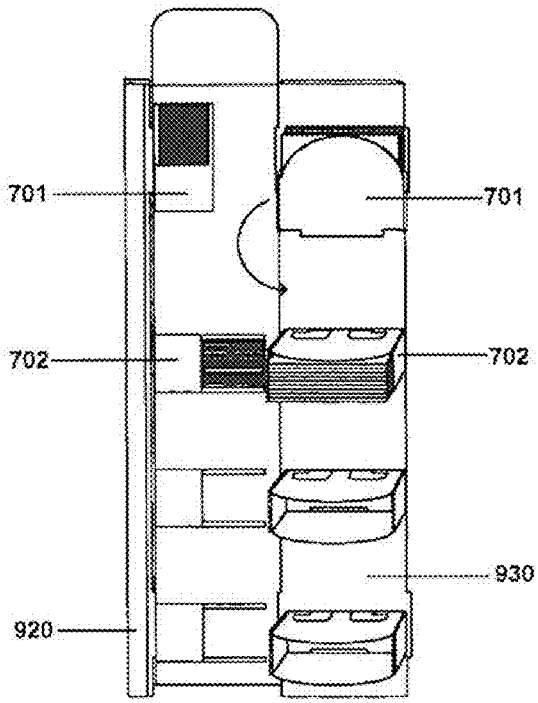
FIG. 16 is a perspective view of FIG. 11 where a display backer box structure is supporting a plurality of shelves.
Figure 17:
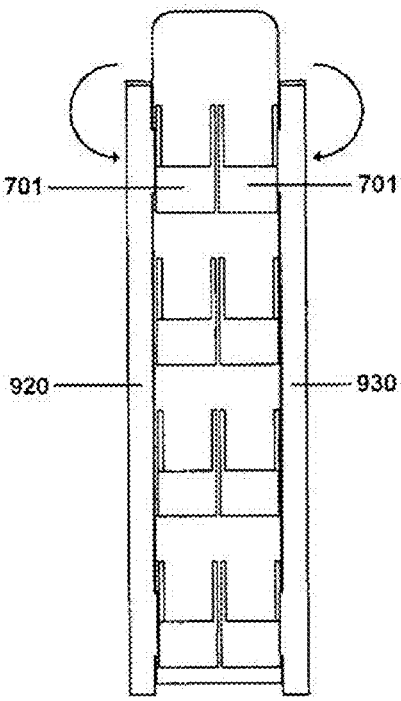
FIG. 17 is a perspective view of FIG. 11 where both display backer box structures are shown with shelves in an up position. This arrangement makes it a narrow profile and efficient to ship.

This alternative embodiment offers many display configurations. FIGS. 13A-I are top views of the FIG. 11 showing that there are a number of ways that box structures 930 and 920 may be rotated in relation to center panel 901. A further embodiment, in FIGS. 14A-I, shows top views where the box structures 930 and 920, are attached to center panel 901 and are of different lengths. FIG. 15 is the front view where the box structures 920 and 940, attached to center panel 901 are of different lengths. FIG. 16 is a partially rotated perspective view of FIG. 11 where box structure 920 and 930 are supporting a plurality of shelves 203. Box 930 is a front view containing shelf 203 in Up position 701 and in Down position 702, while box 920 is rotated to a side view showing the side view shelf 203 in Up position 701 and in Down position 702. FIG. 17 is a fully rotated perspective view of FIG. 11 where both box structures 930 and 920 with shelves 203 in an Up position 701, are rotated inward to a perpendicular position in relation to center panel 901. This arrangement makes it a narrow profile and efficient to ship.

Figure 18:
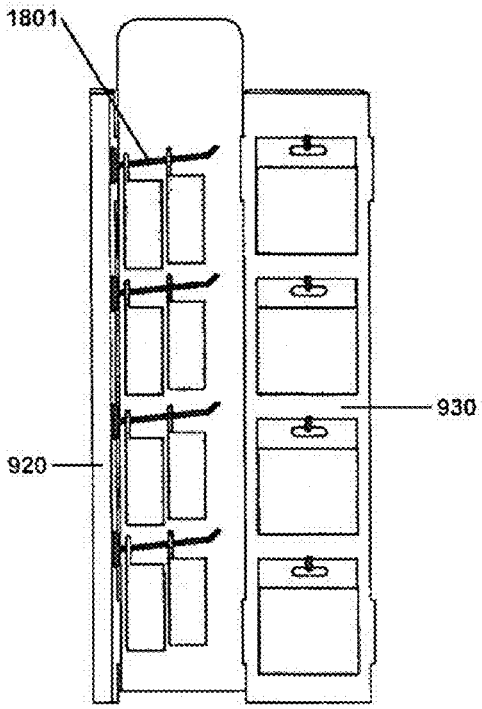
FIG. 18 is a perspective view where the foldable trays are replaced by hooks, upon which product may hang. This embodiment of the invention, although does not include foldable shelves, still offers the user shipping efficiency.

Yet another alternative embodiment of the invention is shown in FIG. 18, a perspective view where the foldable trays 701 are replaced by hooks 1801, upon which product may hang. This embodiment of the invention, although does not include foldable shelves 203, still offers the user shipping efficiency, as boxes 920 and 930 function similarly to FIG. 16, except that this structure will be able to partially benefit from shipping efficiency as only one box 920 may be rotated perpendicular to the center panel 901, as the hooks 1801 are not foldable.

Figure 19:
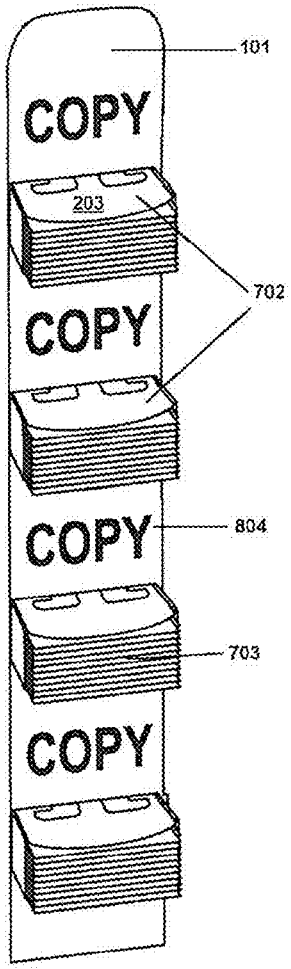
FIG. 19 is a perspective view of FIG. 7 with all trays/shelves rotated down for display from the display backer panel.
Figure 20:
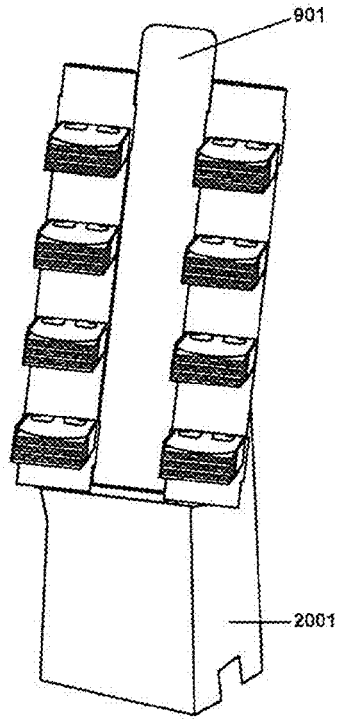
FIG. 20 is a perspective view of FIG. 16 placed on a base to be used as a floor style merchandiser usually around 60" tall. Note here the large amount of space available for selling messages.
Figure 21:
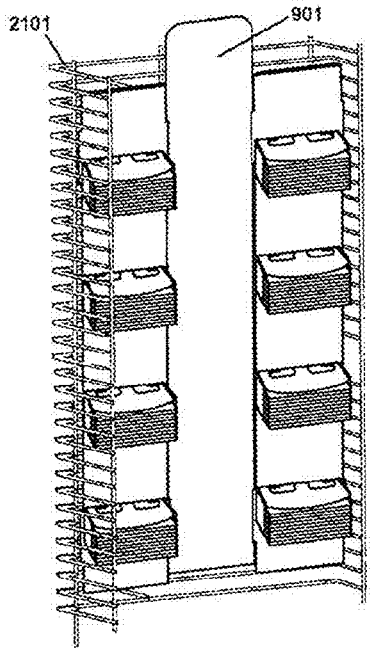
FIG. 21 is a perspective drawing of FIG. 16 hung on a power wing or side kick. This style of display is especially important to marketers who merchandise their products in these fixtures because these styles of store fixtures are reserved for impulse items and high volume goods.

It is the intent of the inventor to make the functionality of the displays such that they offer many display options for the retailers. FIG. 19 is a perspective view of FIG. 7 with all trays/shelves rotated Down position 702 for display from display backer panel 101, clearly exposing the messaging areas 804. Also note that the items in this display are dispensed from the front 703 of the shelf 203. Note this style of display may be placed in many areas of a retail store, as it has a long and narrow profile. The messaging space 804 becomes especially important in smaller displays. FIG. 20 is a perspective view of FIG. 16 placed on a base 2001 to be used as a floor style merchandiser usually under 60" tall. Note here the large amount of "empty" space available for selling messages. FIG. 21 is a perspective drawing of FIG. 16 hung on a power wing or side kick 2101. This style of display is especially important to marketers who merchandise their products in these fixtures because these styles of store fixtures are reserved for impulse items and high volume goods. Being able to have a lot of messaging and display space next to your product in this location may be key to the success of the product(s). It is important to note that these style fixtures have specific display size limits, otherwise the displays will not fit into these fixtures. The industry giant Wal-Mart and many other large retailers have chosen power wing structures that measure 14" long×48" high×3½" deep strategically located, and most retailers insist that the power wing displays are 24" tall, so that two displays may be merchandised on top of one another in a 48" power wing space. This creates a unique problem for some marketers and a specific opportunity for our invention. Those marketers that have products that will not fit snugly across in the 14", as in a product that measures 5" across (not shown). When the products are laid out side by side as they would in the display, you would only be able to fit two items across leaving an unusable space of 4". A marketer in this situation would have two options; make a narrower display, which is not desired as it minimizes their foot print in the store, or fill the extra space in the display with a selling message. This option is also not very desirable because empty space behind the insert, though may provide valuable space for selling messages, it also responsible for higher than necessary shipping costs, as the display is larger than it needs to be, for the amount of product that is being shipped. With our invention, this marketer would have both the necessary messaging space on center panel 901, and, because of the displays unique folding ability, the cost of shipping would be lower because they would be shipping a smaller package, as the empty space behind the center panel (not shown) would disappear when the display is folded for shipment FIG. 17.

Figure 22:
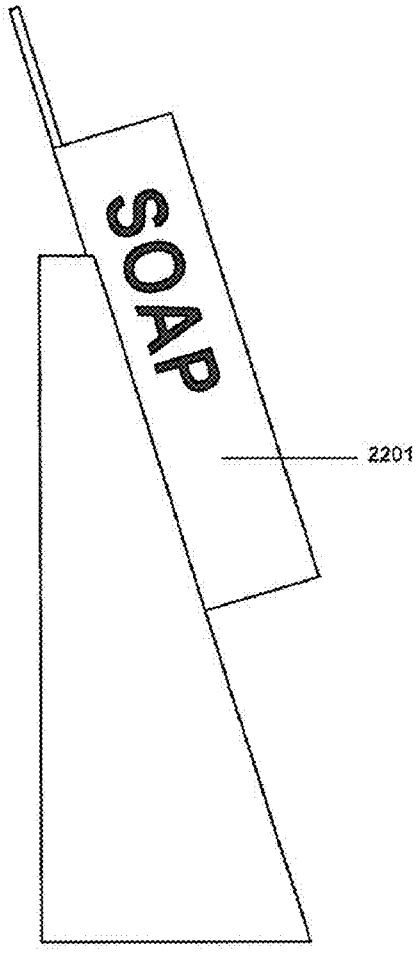
figure 22 (PRIOR ART)
FIG. 22 is a perspective side view of typical displays available in the market where the product is not visible from the side rather only from the front of the display.
Figure 23:
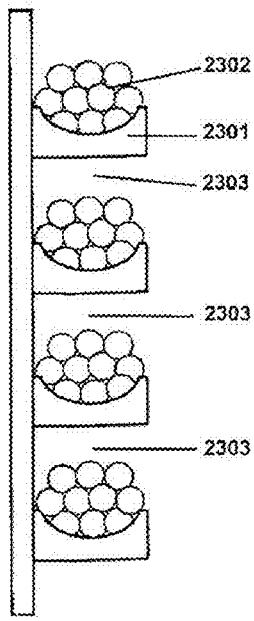
figure 23 (PRIOR ART)
FIG. 23 is a perspective side view of a more desirable display construction, where the more "open" look of the display is more inviting and offers customers a wider viewing angle of the soft sponge ball product. In this display, the shelf is of a fixed construction, whereby it is attractive when displayed in a retail environment, it is more expensive to ship due to the wasted space between the product trays/shelves.

It is worth noting some of the current structures being used in the market. FIG. 22 shows a perspective side view is typical of many displays where the product is often hidden when viewed from the side rather than from the front, as the view is obstructed by the display construction 2201. FIG. 23 is a perspective side view of a more desirable display construction, where the more "open" look of the display is more inviting and offers customers a wider viewing angle of the soft sponge ball product 2302. In this display the shelf 2301 is of a fixed construction, whereby it is attractive when displayed in a retail environment, it is more expensive to ship due to the wasted space 2303 between the product trays/shelves.

Figure 24:
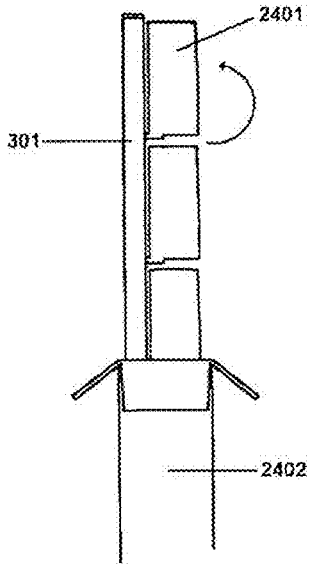
FIG. 24 is a perspective side view of the a similar display shown FIG. 23 with the exception that the shelves are foldable and rotated "Up" for shipping efficiency and is shown being lowered into shipping container. Note "nesting" way of the shelves in this position.
Figure 25:
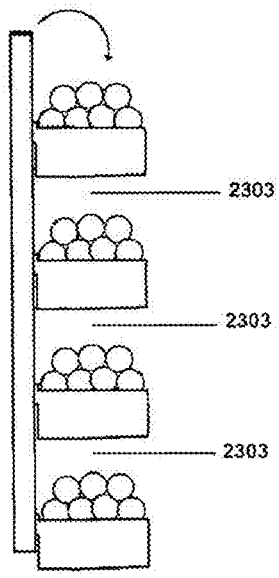
FIG. 25 is a perspective side view of the same display as FIG. 24, with the shelves in a "Down" position, revealing the space in between the tray/shelves available for messaging.

In the preferred embodiment the shelf structure is foldable. FIG. 24 is a perspective side view of a similar display shown FIG. 23 with the exception that the shelves 2401 are foldable and rotated up 701 for shipping and is shown being lowered into shipping container 2402. Also note that shelves 2401 have minimal space between them in the up position 701. FIG. 25 is a perspective side view of the same display as FIG. 24, which is similar to the display shown in FIG. 23. Even though it has a significantly narrower profile for shipping shown in FIG. 24, it merchandises very similarly to the fixed shelf structure shown in FIG. 23, with plenty of space 2303 in between the tray/shelves 2401 for messaging.

Figure 26:
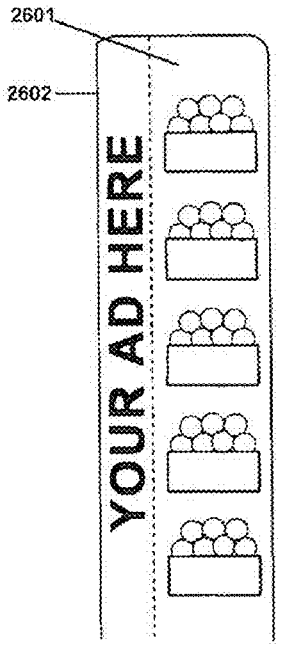
FIG. 26 is a perspective drawing where the backer panel has an extra foldable flap that may be used for additional messaging.
Figure 27:
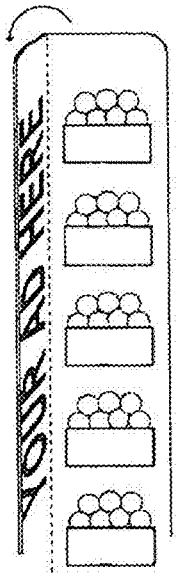
FIG. 27 is a perspective view of FIG. 26 where the back panel is being rotated towards the shelves for more efficient shipping.
Figure 28:
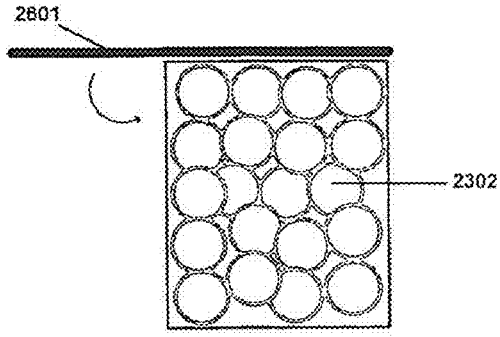
FIG. 28 is a top view of FIG. 26 with the shelf in a "Down" position with the back panel in an unfolded position.
Figure 29:
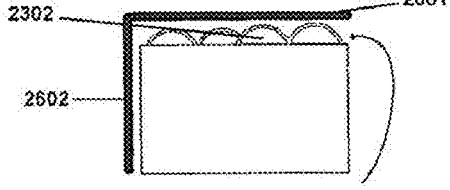
FIG. 29 is a top view of FIG. 27 with the shelf in the "Up" position with the back panel in a folded position.

Yet another embodiment of the invention is shown in FIG. 26, a perspective drawing where the back panel 2601 is similar to back panel 101, with the exception that it has an extra foldable flap that may be used for additional messaging. Back panel 2601 may or may not be foldable. The foldable nature would be desired to reduce shipping costs. FIG. 27 is a perspective view of FIG. 26 where the back panel 2602 is being rotated towards the shelves 2401 for more efficient shipping. FIG. 28 is a top view of FIG. 26 with the shelf in a down position 702 with the back panel 2601 in an unfolded position. FIG. 29 is a top view of FIG. 27 with the shelf in the up position 701 with the back panel in a folded position where flap 2602 is rotated for more efficient shipping. It is important to note that the up position of shelf 701 is useful to help compress certain products for more efficient shipping. This is important where the visual appeal of the product is enhanced when the trays appear as if they are spilling over. This would only work for those products soft enough in nature that they would easily collapse when the shelves are rotated up during shipping and would again regain their structure once the shelf is in the down position 702. Soft toys, sponges, balls, loofas squishy novelty items are some of the products that could benefit from such a construction.

Figure 30:
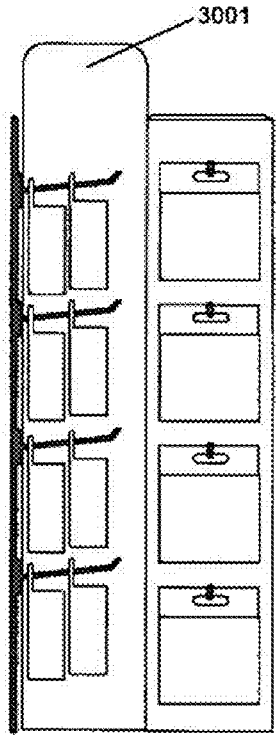
FIG. 30 is a perspective view of FIG. 18 with the difference that display backer boxes are replaced with a simple backer panel with hook attachments to hold product.
Figure 31:
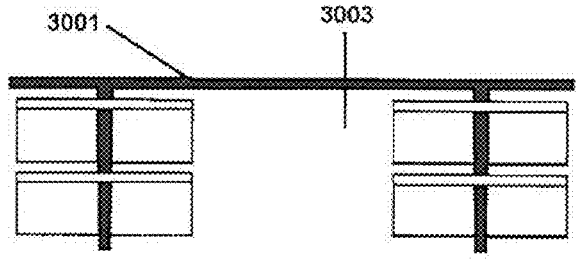
FIG. 31 is a top view of FIG. 30 in the open display position.
Figure 32:
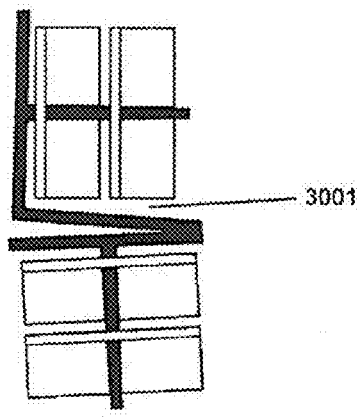
FIG. 32 is a top view of FIG. 30 when it is folded to eliminate the empty space between the product sections for efficient shipping.

Yet another embodiment of the invention is where the foldable shelves are replaced by hooks. FIG. 30 is a perspective view of FIG. 18 with the difference that display backer boxes 920 and 930 are replaced with a back panel similar to panel 101 (FIG. 1) with hook attachments to hold product. It is the intention of the inventor to have a minimal structure necessary to hold the product and yet be low cost and still have the market impact by offering a center area separated by folds that would allow for a large area for selling messages. It is worth noting that the paperboard or plastic needs to be sufficiently rigid to support the product it is displaying. FIG. 31 is a top view of FIG. 30 in the open display position. It is worth noting that if necessary the paperboard may be extended left and right so as to create enough material to fold to the rear of the display in order to provide further support to the display and to keep the back of the display looking clean an neat (not shown). FIG. 32 is a top view of FIG. 30 when it is folded to eliminate the empty space 3003 between the product sections for efficient shipping.

I claim:

1. A foldable display comprising:

a display backer; and at least one shelf including an opening for holding a product within the at least one shelf, wherein the at least one shelf is pivotally coupled to a front surface of the display backer and is pivotal between a first position extending along a surface of the display backer and a second position extending substantially perpendicularly from the display backer, wherein the at least one shelf is configured to hold the product in the opening in the first position and in the second position, wherein the display backer and the at least one shelf cooperate to create a three-dimensional self-supporting display structure.

2. The foldable display of claim 1, wherein the at least one shelf includes a pair of tabs extending therefrom, and the display backer includes at least one pair of slits disposed within the front surface of the display backer, each pair of slits configured to receive a respective pair of tabs of one of the at least one shelf in the first position and the second position.

3. The foldable display of claim 2, wherein the at least one pair of slits includes a plurality of pairs of slits, each pair of slits receiving a respective one of a pair of tabs of each shelf, wherein each shelf is pivotal between the first position and the second position.

4. The foldable display structure of claim 2, wherein each tab includes a flap movable after the tab has been inserted into a respective slit to retain the shelf pivotally against the display backer.

* * * * *